US010364622B2

(12) United States Patent
Gardner et al.

(10) Patent No.: US 10,364,622 B2
(45) Date of Patent: Jul. 30, 2019

(54) MANIFOLD ASSEMBLY FOR A MINERAL EXTRACTION SYSTEM

(71) Applicant: Cameron International Corporation, Houston, TX (US)

(72) Inventors: Laura M. Gardner, Cypress, TX (US); Kathy Hickman, Houston, TX (US); Sundeep Yalamanchi, Houston, TX (US)

(73) Assignee: Cameron International Corporation, Houston, TX (US)

( * ) Notice: Subject to any disclaimer, the term of this patent is extended or adjusted under 35 U.S.C. 154(b) by 0 days.

(21) Appl. No.: 15/440,083

(22) Filed: Feb. 23, 2017

(65) Prior Publication Data

US 2018/0238129 A1 Aug. 23, 2018

(51) Int. Cl.

| | |
|---|---|
| ***E21B 21/01*** | (2006.01) |
| ***E21B 21/06*** | (2006.01) |
| ***E21B 21/10*** | (2006.01) |

(52) U.S. Cl.

CPC ..... *E21B 21/01* (2013.01); *E21B 21/063* (2013.01); *E21B 21/106* (2013.01)

(58) Field of Classification Search

CPC ..... E21B 21/001; E21B 21/01; E21B 21/063; E21B 21/10; E21B 21/106

See application file for complete search history.

(56) References Cited

U.S. PATENT DOCUMENTS

| | | | | |
|---|---|---|---|---|
| 7,562,723 | B2 * | 7/2009 | Reitsma | E21B 21/08 175/217 |
| 9,080,407 | B2 * | 7/2015 | Bernard | E21B 21/08 |
| 9,309,732 | B2 * | 4/2016 | Boyd | E21B 21/063 |
| 9,441,429 | B2 * | 9/2016 | Sherwood | E21B 15/00 |
| 9,500,053 | B2 * | 11/2016 | Leuchtenberg | E21B 33/038 |
| 9,506,305 | B2 * | 11/2016 | Leuchtenberg | E21B 21/001 |
| 9,605,502 | B2 * | 3/2017 | Leuchtenberg | E21B 21/08 |
| 2005/0236051 | A1 * | 10/2005 | McBeth | F16K 11/074 137/625.11 |
| 2006/0086538 | A1 * | 4/2006 | Van Riet | E21B 21/106 175/66 |
| 2010/0084142 | A1 * | 4/2010 | Calderoni | A61K 31/385 166/380 |
| 2011/0139464 | A1 * | 6/2011 | Henderson | E21B 21/01 166/370 |
| 2014/0318772 | A1 * | 10/2014 | Boyd | E21B 21/106 166/267 |

(Continued)

FOREIGN PATENT DOCUMENTS

WO WO 2016176596 A1 * 11/2016 ..... G01F 25/0007

*Primary Examiner* — Matthew R Buck
(74) *Attorney, Agent, or Firm* — Helene Raybaud

(57) ABSTRACT

The disclosed embodiments relate to a system that includes a manifold assembly having a first drilling fluid flow path configured to enable operation of a first drilling technique for a mineral extraction system, where the first drilling fluid flow path has a first inlet and one or more first outlets and a second drilling fluid flow path configured to enable operation of a second drilling technique for the mineral extraction system, different from the first drilling technique, where the second drilling fluid flow path has a second inlet and one or more second outlets, and where the first drilling fluid flow path and the second drilling fluid flow path are different from one another.

14 Claims, 6 Drawing Sheets

(56) References Cited

U.S. PATENT DOCUMENTS

| | | | | |
|---|---|---|---|---|
| 2016/0097270 | A1* | 4/2016 | Pobedinski | E21B 44/00 700/275 |
| 2017/0044857 | A1* | 2/2017 | Leuchtenberg | E21B 33/085 |
| 2018/0135366 | A1* | 5/2018 | Olsen | E21B 21/08 |

* cited by examiner

MANIFOLD ASSEMBLY FOR A MINERAL EXTRACTION SYSTEM

BACKGROUND

This section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

Oil and natural gas have a profound effect on modern economies and societies. In order to meet the demand for such natural resources, numerous companies invest significant amounts of time and money in searching for, accessing, and extracting oil, natural gas, and other subterranean resources. Particularly, once a desired resource is discovered below the surface of the earth, drilling and production systems are often employed to access and extract the resource. These systems can be located onshore or offshore depending on the location of a desired resource. Such systems may include a drilling fluid system configured to circulate drilling fluid into and out of a wellbore to facilitate the drilling process. In some cases, the drilling fluid may be directed to a platform of the drilling system, where the drilling fluid may be filtered and/or otherwise processed before being directed back into the wellbore. Unfortunately, manifolds that receive the drilling fluid include pipes and/or valves that direct the drilling fluid to various locations of the system, and such manifolds may be configured for specific types of drilling. Therefore, multiple manifolds may be included in the drilling system in order to enable the system to perform multiple types of drilling techniques. Such manifolds may be expensive and include a relatively large footprint.

BRIEF DESCRIPTION OF THE DRAWINGS

Various features, aspects, and advantages of the present disclosure will become better understood when the following detailed description is read with reference to the accompanying figures in which like characters represent like parts throughout the figures, wherein.

DETAILED DESCRIPTION OF SPECIFIC EMBODIMENTS

Figure 1:
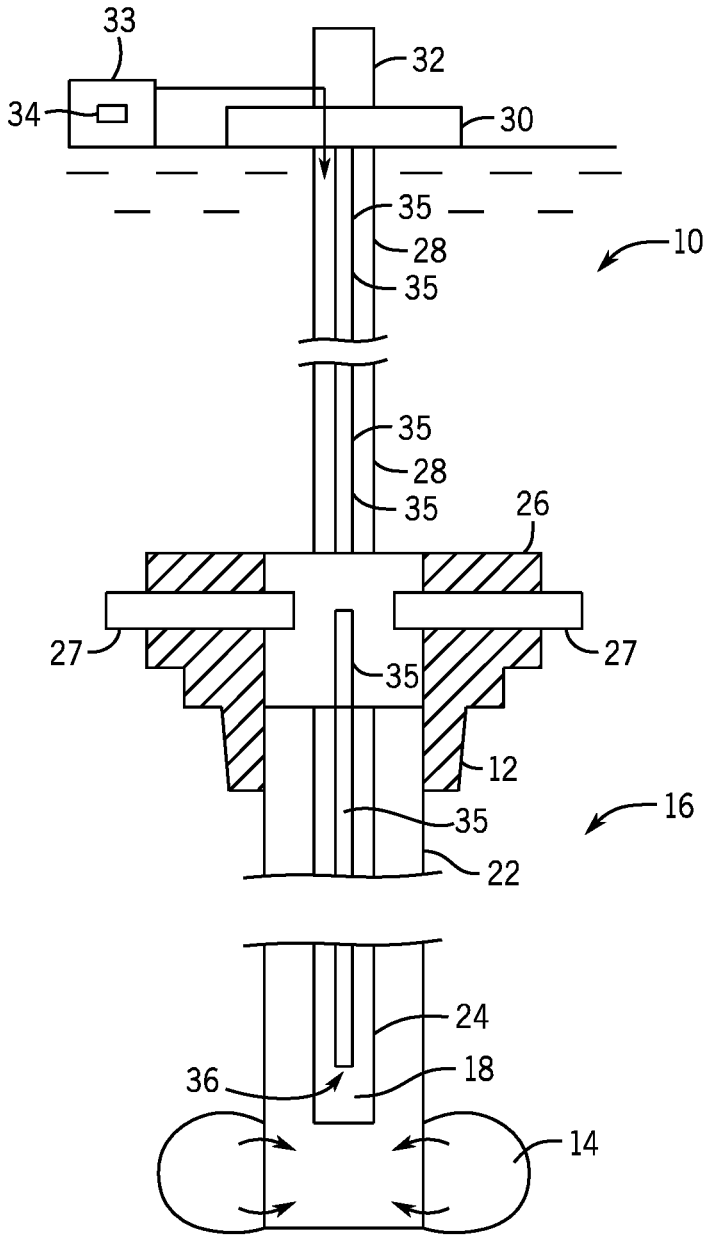
FIG. 1 is a schematic of a mineral extraction system that includes an enhanced manifold assembly, in accordance with an aspect of the present disclosure.

One or more specific embodiments of the present disclosure will be described below. These described embodiments are only exemplary of the present disclosure. Additionally, in an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," "the," and "said" are intended to mean that there are one or more of the elements. The terms "comprising," "including," and "having" are intended to be inclusive and mean that there may be additional elements other than the listed elements. Moreover, the use of "top," "bottom," "above," "below," and variations of these terms is made for convenience, but does not require any particular orientation of the components.

Without the present disclosure, mineral extraction systems may include multiple manifolds to enable the system to switch between multiple types of drilling techniques (e.g., managed pressure drilling and well control drilling). It may be desirable to switch between drilling techniques based on a hardness of a particular layer in which drilling is occurring. Unfortunately, each manifold that may be included in the different types of mineral extraction systems includes a relatively large footprint, thereby utilizing a large of amount of relatively limited space available on a rig. Accordingly, embodiments of the present disclosure relate to a single, enhanced manifold assembly that may enable multiple types of drilling techniques to be performed by the mineral extraction system. Such an enhanced manifold assembly includes a reduced footprint when compared to multiple manifolds, which may create more space for additional components. Further, the enhanced manifold assembly may reduce costs by enabling a single manifold to be purchased for the system rather than multiple manifolds. Additionally, in some embodiments, the enhanced manifold assembly may include at least a first portion of a drilling fluid flow path that is positioned on a first plane and a second portion of the drilling fluid flow path that is positioned on a second plane, where the first plane and the second plane are crosswise (e.g., substantially perpendicular) to one another. In other embodiments, components of the enhanced manifold assembly may be stacked vertically, such that a first component is at a first vertical height (e.g., from a platform) and a second component is at a second vertical height (e.g., from the platform), different from the first vertical height. Positioning portions of the drilling fluid flow path in such a manner may further reduce a footprint of the enhanced manifold assembly, thereby providing additional space for components.

To help illustrate the manner in which the present embodiments may be used in a system, FIG. 1 is a block diagram that illustrates an embodiment of a mineral extraction system 10. The illustrated mineral extraction system 10 can be configured to extract various minerals and natural resources, including hydrocarbons (e.g., oil and/or natural gas), or configured to inject substances (e.g., drilling fluid, particle laden fluids or frac fluids, chemicals, gases, water, mud, etc.) into the earth. In some embodiments, the mineral extraction system 10 is land-based (e.g., a surface system) or subsea (e.g., a subsea system). As illustrated, the system 10 includes a wellhead assembly 12 coupled to a mineral deposit 14 via a well 16, wherein the well 16 includes a wellbore 18.

The wellhead assembly 12 typically includes multiple components that control and regulate activities and conditions associated with the well 16. For example, the wellhead assembly 12 generally includes pipes, bodies, valves and seals that enable drilling of the well 16, route produced minerals from the mineral deposit 14, provide for regulating pressure in the well 16, and provide for the injection of drilling fluids into the wellbore 18 (down-hole). For example, FIG. 1 illustrates a conductor 22 (also referred to as "conductor casing") disposed in the well 16 to provide structure for the well 16 and prevent collapse of the sides of the well 16 into the wellbore 18. One or more casings 24, such as surface casing, intermediate casing, etc., may be fully or partially disposed in the bore of the conductor 22. The casing 24 also provides a structure for the well 16 and wellbore 18 and provides for control of fluid and pressure during drilling of the well 16. The wellhead 12 may include, a tubing spool, a casing spool, and a hanger (e.g., a tubing hanger or a casing hanger), to enable installation of casing and/or tubing. The system 10 may include other devices that are coupled to the wellhead 12, such as a blowout preventer (BOP) 26 and devices that are used to assemble and control various components of the wellhead 12.

The BOP 26 may include a variety of valves, fittings and controls to prevent oil, gas, or other fluid from exiting the well in the event of an unintentional release of pressure or an unanticipated overpressure condition. As used herein the term "BOP" may also refer to a "BOP stack" having multiple blowout preventers. The BOP 26 may be hydraulically operated and may close the wellhead assembly 12 or seal off various components of the wellhead assembly 12. During operation of the system 10, a BOP 26 may be installed during removal or installation of additional components, changes in operation of the system 10, or for other reasons. The BOP 26 may be any suitable BOP, such as a ram BOP, an annular BOP, or any combination thereof. The BOP 26 shown in FIG. 1 may be a ram BOP having radially moveable rams 27 configured to close off the bore of the BOP 26 and seal the well 16.

A drilling riser 28 may extend from the BOP 26 to a rig 30, such as a platform or floating vessel. The rig 30 may be positioned above the well 16. The rig 30 may include the components suitable for operation of the mineral extraction system 10, such as pumps, tanks, power equipment, and any other components. The rig 30 may include a derrick 32 to support the drilling riser 28 during running and retrieval, a tension control mechanism, and any other components.

The drilling riser 28 may carry drilling fluid (e.g., "mud") from the rig 30 to the well 16, and may carry the drilling fluid ("returns"), cuttings, or any other substance, from the well 16 to the rig 30. For example, in certain embodiments, the mineral extraction system 10 may include a drilling fluid system 33 that directs the drilling fluid from a source, into the well 16, and back out of the well 16 to a predetermined destination (e.g., a waste container, a reserve pit, or another fluid container). The drilling fluid system 33 may include an enhanced manifold assembly 34 that may enable multiple types of drilling procedures to be performed by the mineral extraction system 10. The drilling riser 28 may also include a drill pipe 35. The drill pipe 35 may be connected centrally over the bore (such as coaxially) of the well 16, and may provide a passage from the rig 30 to the well 16.

FIG. 1 depicts operation of the mineral extraction system 10 during drilling of the well. As shown in FIG. 1, the drill pipe 35 extends from the derrick 32 through the BOP 26, through the drilling riser 28, and into the wellbore 18. The drill pipe 35 may be coupled to a tool, e.g., a drill bit, to aid in drilling the well. For example, in one embodiment the drill pipe 35 may be rotated and/or translated to drill and create the well. Drilling fluid may be directed toward an end 36 of the drill pipe 35 to facilitate movement of the drill pipe 35 and/or the tool (e.g., drill bit) within the well 16. Specifically, the drilling fluid may remove the cuttings and/or other solids from the end 36 of the drill pipe 35 that may block movement of the drill pipe 35 and/or the drill bit. Additionally, the drill pipe 35 may be extended or retracted by adding or removing sections to the drill pipe 35.

Figure 2:
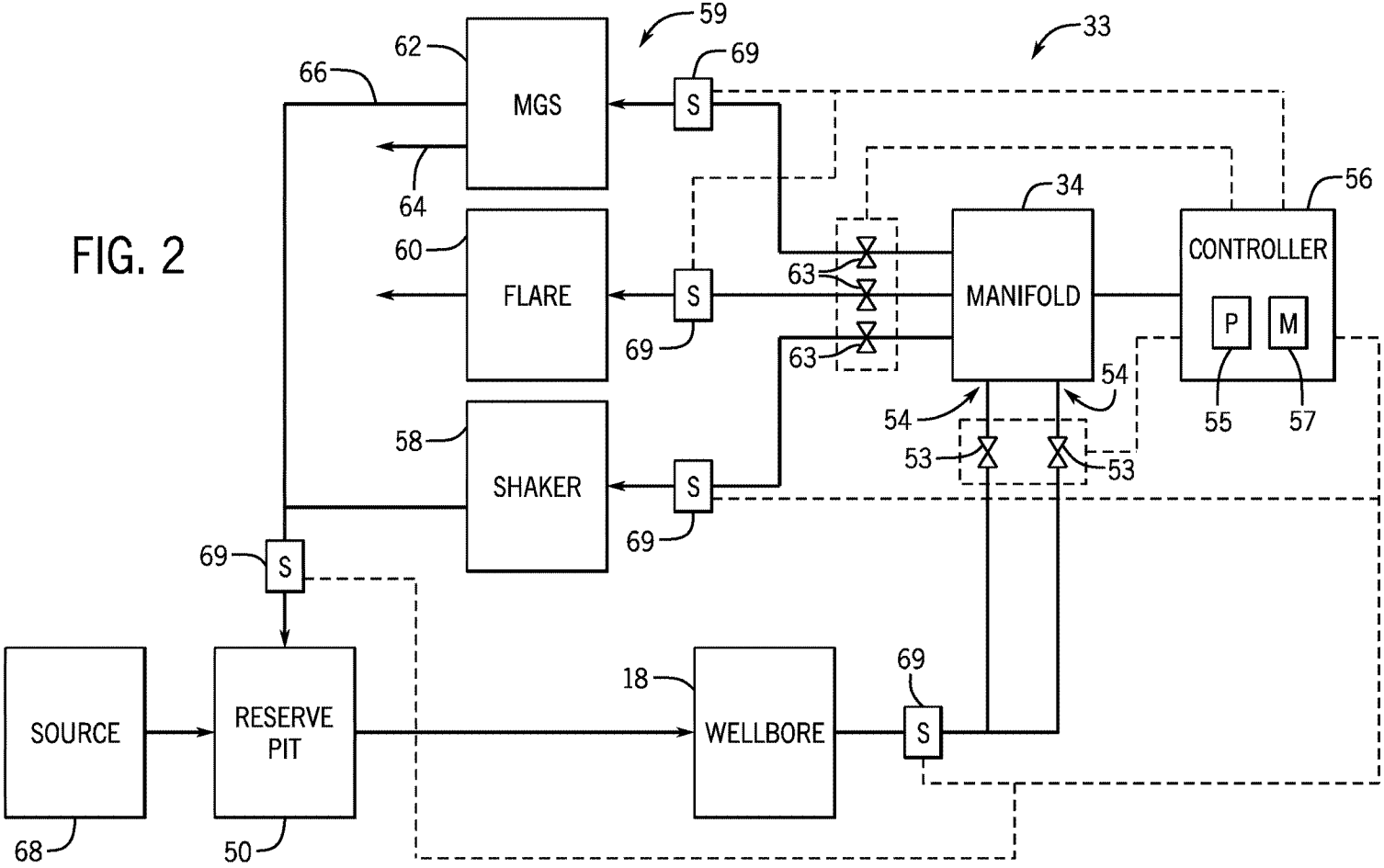
FIG. 2 is a schematic of a drilling fluid system that may include the enhanced manifold assembly of FIG. 1, in accordance with an aspect of the present disclosure.

As discussed above, drilling fluid may be directed into and out of the wellbore 18 through the manifold assembly 34 of the drilling fluid system 33. For example, FIG. 2 is a schematic of the drilling fluid system 33. Drilling fluid may be directed from a fluid container 50 (e.g., a reserve pit) to the wellbore 18. In some embodiments, the drilling fluid may undergo processing (e.g., filtering) between the fluid container 50 and the wellbore 18 to remove relatively large particles and/or other undesirable material from the drilling fluid. In any case, the drilling fluid may eventually flow out of the wellbore 18 and toward the manifold assembly 34 of the drilling fluid system 33. The manifold assembly 34 may receive the drilling fluid through one or more inlets 54 (e.g., valves driven by actuators). As shown in the illustrated embodiment, a pressure and/or flow rate of the drilling fluid entering the manifold assembly 34 through the one or more inlets 54 may be controlled by one or more inlet valves 53. In some embodiments, the manifold assembly 34 may be coupled to a controller 56 (e.g., electronic controller having a processor 55 and memory 57) that may be configured to control the inlets 54 (e.g., the one or more inlet valves 53) of the manifold assembly 34, and thus, a predetermined flow path that the drilling fluid takes through the manifold assembly 34. For example, the flow path of the drilling fluid through the manifold assembly 34 may be indicative of the drilling technique that is used by the mineral extraction system 10. The manifold assembly 34 may have at least a first drilling fluid flow path (see, e.g., FIG. 3) and a second drilling fluid flow path (see, e.g., FIG. 4). In some embodiments, the manifold assembly 34 may be configured to direct the drilling fluid along one, two, three, four, five, six, seven, eight, nine, ten, or more flow paths.

The manifold assembly 34 may then direct the drilling fluid to one or more downstream components 59 that may be configured to process (e.g., filter and/or clean) the drilling fluid and/or dispose of the drilling fluid. For example, the downstream components 59 may include a shaker 58 (e.g., a perforated or mesh plate that may undergo vibrations to remove large particles from the drilling fluid), a flare 60, and/or a mud gas separator 62, among others. As shown in the illustrated embodiment of FIG. 2, a pressure and/or a flow rate of the drilling fluid exiting the manifold assembly 34 may be controlled by one or more outlet valves 63. The one or more outlet valves 63 may be coupled to the controller 56, which may be configured to adjust a position of the one or more outlet valves 63 to adjust the pressure and/or the flow rate toward the shaker 58, the flare 60, and/or the mud gas separator 62. In some embodiments, the shaker 58 may be configured to vibrate the drilling fluid to remove relatively large particles from the drilling fluid. Removal of the relatively large particles of the drilling fluid may substantially prevent blockage and/or restrictions within the wellbore 18. As such, the drilling fluid that exits the shaker 58 may be recycled back to the fluid container 50 and ultimately directed back into the wellbore 18.

When the drilling fluid is in the wellbore 18, the drilling fluid may collect minerals (e.g., hydrocarbons) that are present in the wellbore 18. In some embodiments, a portion of the drilling fluid may be directed to the flare 60. The flare 60 (e.g., a combustion chamber, a flare outlet, an ignition system) may be configured to receive the drilling fluid and combust any hydrocarbons and/or minerals that may be present in the drilling fluid. Additionally, the mud gas separator 62 (e.g., a flash chamber and/or another chamber that may enable gas to separate from the drilling fluid) may be configured to separate the minerals (e.g., hydrocarbons) 64 from the drilling fluid 66. In some embodiments, the drilling fluid 66 exiting the mud gas separator 62 may be directed back to the fluid container 50. Additionally, the minerals 64 may be directed to a supplier and/or to another suitable component of the mineral extraction system (e.g., the flare 60).

In any case, the fluid container 50 may receive recycled drilling fluid from the downstream components 59. Additionally, the fluid container 50 may also receive fresh drilling fluid from a source 68 because an amount of drilling fluid returned to the fluid container 50 from the wellbore 18 may be less than an amount originally supplied to the wellbore 18. Accordingly, the source 68 may replenish any drilling fluid that may be lost during the drilling process.

As discussed above, the manifold assembly 34 may be configured to enable the mineral extraction system 10 to operate using multiple drilling techniques. In accordance with embodiments of the present disclosure, the manifold assembly 34 may be configured to enable both managed pressure drilling ("MPD") and well control drilling ("WCD").

As used herein, MPD may refer to drilling operations that may be utilized when drilling through a sea floor made of relatively soft materials (i.e., materials other than hard rock). MPD may regulate the pressure and flow of drilling fluid through an inner drill string to ensure that the drilling fluid flow into the wellbore 18 does not over pressurize the wellbore 18 (i.e., expand the wellbore 18) or allow the wellbore 18 to collapse under its own weight. The ability to manage the drilling fluid pressure therefore enables drilling of mineral reservoirs in locations with softer sea beds.

Additionally, WCD may refer to more traditional drilling techniques that do not control pressure within the wellbore 18 with as much accuracy as MPD. Rather, WCD techniques may utilize a choke line and a choke valve that enables a pressure drop of drilling fluid exiting the wellbore 18, but does not ultimately provide for accurate pressure control within the wellbore 18. It may be beneficial to utilize WCD techniques when the formation includes relatively hard material (e.g., rock). Such formations may withstand higher pressures of drilling fluid without cracking and/or otherwise enabling drilling fluid to leak into the formation. Accordingly, fine control of the drilling fluid pressure in the wellbore 18 may not be necessary.

However, it may be beneficial for a mineral extraction system 10 to switch (e.g., via the controller 56) between drilling techniques such as MPD and WCD based on a hardness of a particular layer in which drilling is occurring and/or another operating parameter of the mineral extraction system 10 (e.g., pressure, temperature, formation type, mineral type, drilling fluid type, etc.). As a non-limiting example, a formation may include multiple layers, which may include different materials that include different hardness levels. Accordingly, it may be desirable to switch from WCD to MPD when entering a layer of the formation that is relatively soft to adjust the pressure of the drilling fluid and ensure that the drilling fluid does not crack the formation and/or allow drilling fluid to leak into the formation. Similarly, when entering a layer of the formation that is relatively hard, it may be beneficial to switch from MPD to WCD because control of the drilling fluid pressure may not be necessary. In some embodiments, the controller 56 may control the manifold assembly 34 (e.g., the valves 53 and/or 63) to switch between MPD and WCD. The controller 56 may be coupled to one or more sensors 69 which may provide the controller 56 with feedback related to characteristics of the drilling fluid. In some cases (e.g., during MPD drilling), the controller 56 may adjust the valves 53 and 63 and/or other components of the manifold assembly 34 to control a pressure in the well 16 based on the feedback from the sensors 69.

As discussed above, certain mineral extraction systems include multiple manifolds that are used to enable switching between drilling techniques (e.g., MPD and WCD). However, each of the multiple manifolds includes a relatively large footprint, thereby utilizing space on the rig 30 that is relatively limited. Accordingly, embodiments of the present disclosure relate to a single, enhanced manifold assembly 34 that may enable multiple types of drilling techniques to be performed by the mineral extraction system 10. Such an enhanced manifold assembly 34 includes a reduced footprint when compared to multiple manifolds, which creates more space on the rig 30 for additional components. Additionally, the enhanced manifold assembly 34 may reduce costs of the system 10 by enabling a single manifold to be purchased rather than multiple manifolds.

Figure 3:
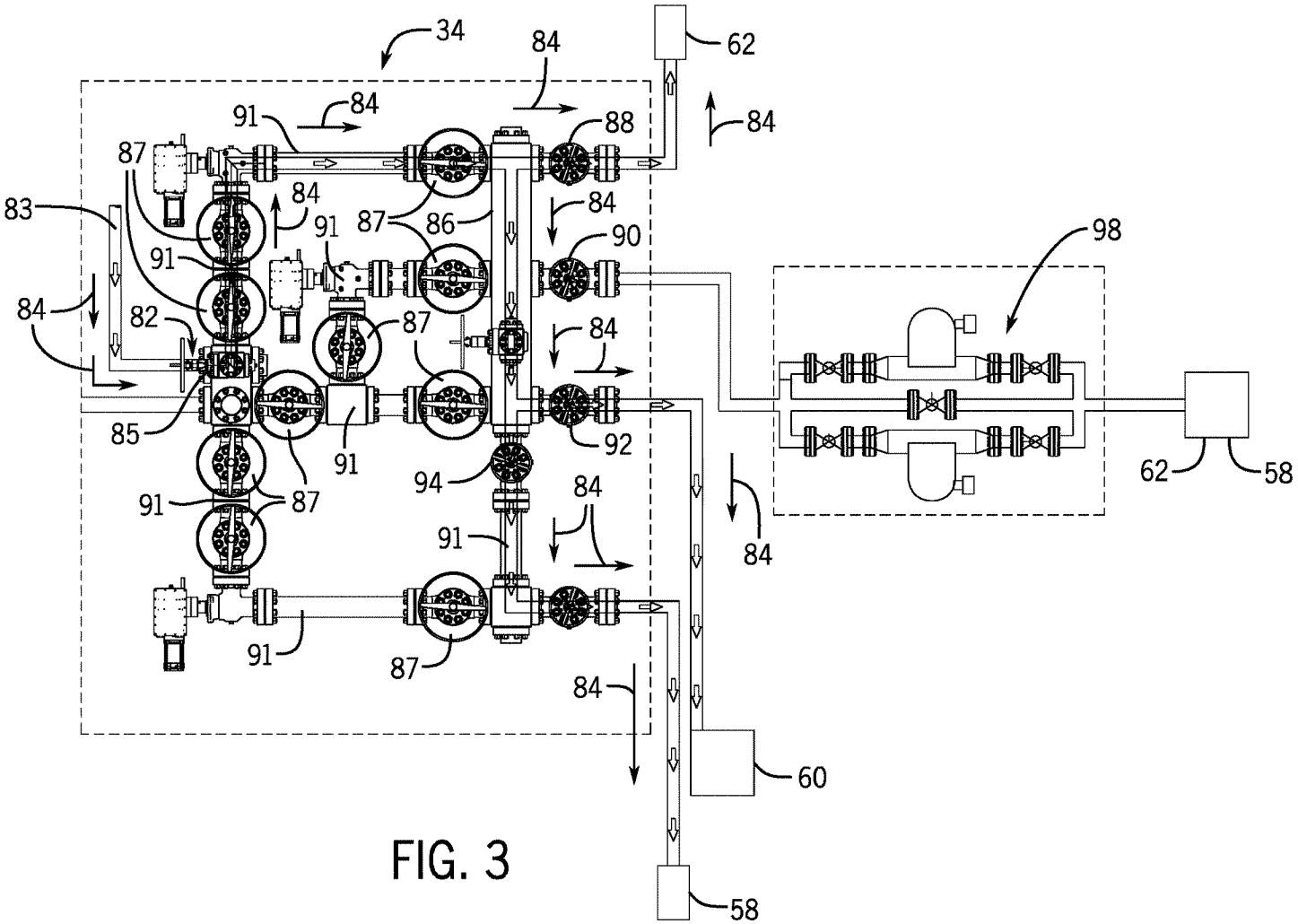
FIG. 3 is schematic of a first drilling fluid flow path through the enhanced manifold assembly that enables the mineral extraction system to perform a first drilling technique, in accordance with an aspect of the present disclosure.

FIG. 3 is a schematic of an embodiment of the manifold assembly 34 when the mineral extraction system 10 operates using the WCD technique. As shown in the illustrated embodiment of FIG. 3, the manifold assembly 34 may receive a flow of fluid 80 from a first inlet 82. The first inlet 82 may be coupled to the wellbore 18, and in some embodiments, the first inlet 82 may be coupled to a choke line 83 of the mineral extraction system 10. As used herein, a choke line may be a flow path that directs high pressure drilling fluid from the drilling riser 28 toward the rig 30. A first drilling fluid flow path through the manifold assembly 34 when the system 10 operates using the WCD technique is represented by arrows 84.

The manifold assembly 34 may include a choke valve 85 (e.g., an adjustable plug disposed in a conduit that may choke a flow of the drilling fluid from the well 16 to the manifold assembly 34) that may reduce a pressure of the drilling fluid entering the manifold assembly 34. As shown in the illustrated embodiment of FIG. 3, the manifold assembly 34 may further include a plurality of valves 87 disposed along one or more conduits 91 of the manifold assembly 34. In some embodiments, the plurality of valves 87 may include ball valves, needle valves, manual wheel valves, electronically actuated valves, and/or another suitable valve. While the illustrated embodiment of FIG. 3 shows the manifold assembly 34 having ten of the valves 87, it should be noted that in other embodiments, the manifold assembly 34 may have less than ten of the valves 87 or more than ten of the valves 87.

In any case, the choke valve 85 may be fluidly coupled to a common manifold 86 of the manifold assembly 34 (e.g., a one-piece manifold that is common to multiple flow paths through the manifold assembly 34) that may distribute the drilling fluid to one or more destinations. For example, the common manifold 86 may include a first valve 88, a second valve, 90, a third valve 92, and/or a fourth valve 94. While the illustrated embodiment of FIG. 3 shows the common manifold 86 having four valves, it should be noted that in other embodiments, the common manifold 86 may include less than four valves (e.g., three, two, or one valve) or more than four valves (e.g., five, six, seven, eight, nine, ten, or more valves). Each of the valves 88, 90, 92, and/or 94 may direct the drilling fluid to a different component and/or destination of the mineral extraction system 10. Accordingly, a position of each of the valves 88, 90, 92, and/or 94 may be adjusted in order to control which of the components and/or destinations that the drilling fluid flows.

For example, the first valve 88 may be coupled to the mud gas separator 62 where the drilling fluid may be separated from minerals (e.g., hydrocarbons) collected when the drilling fluid flowed within the wellbore 18. An operator and/or the controller 56 may open the first valve 88 in situations where the drilling fluid has a high concentration of gases (e.g., as determined by a sensor 96 and/or another suitable device). Additionally, the second valve 90 may direct the drilling fluid to a flow meter 98 (e.g., ultrasonic flow meters, fixed or variable orifices, venturies, rotameters, pitot tubes, thermal flow meters, coriolis flow meters, or other suitable flow meters), which may ultimately be coupled to the mud gas separator 62 and/or the shaker 58. As shown in the illustrated embodiment of FIG. 3, the second valve 90 may be closed when the mineral extraction system 10 operates using the WCD technique (e.g., drilling fluid does not flow through the second valve 90). The flow meter 98 may provide relatively fine control over the flow of the drilling fluid flowing toward the mud gas separator 62 and/or the shaker 58, which may not be desired when operating using the WCD technique.

Additionally, the third valve 92 may be coupled to the flare 60 and the fourth valve 94 may be coupled to the shaker 58. It may be desirable to direct the drilling fluid to the flare 60 when the drilling fluid becomes saturated with flammable minerals (e.g., hydrocarbons), such that separation of the drilling fluid in the mud gas separator 62 may not be successful. Additionally, the drilling fluid may be directed to the shaker 58 when the drilling fluid collects large particles as the drilling fluid flows through the wellbore 18.

As shown in the illustrated embodiment, the first valve 88, the third valve 92, and the fourth valve 94 are open when the mineral extraction system 10 operates in using the WCD technique. However, in other embodiments, another suitable combination of the valves 88, 90, 92, and/or 94 may be in the open position. In some embodiments, the valves 88, 90, 92, and/or 94 may be ball valves, butterfly valves, gate valves, globe valves, diaphragm valves, needle valves, another suitable valve, and/or a combination thereof.

Figure 4:
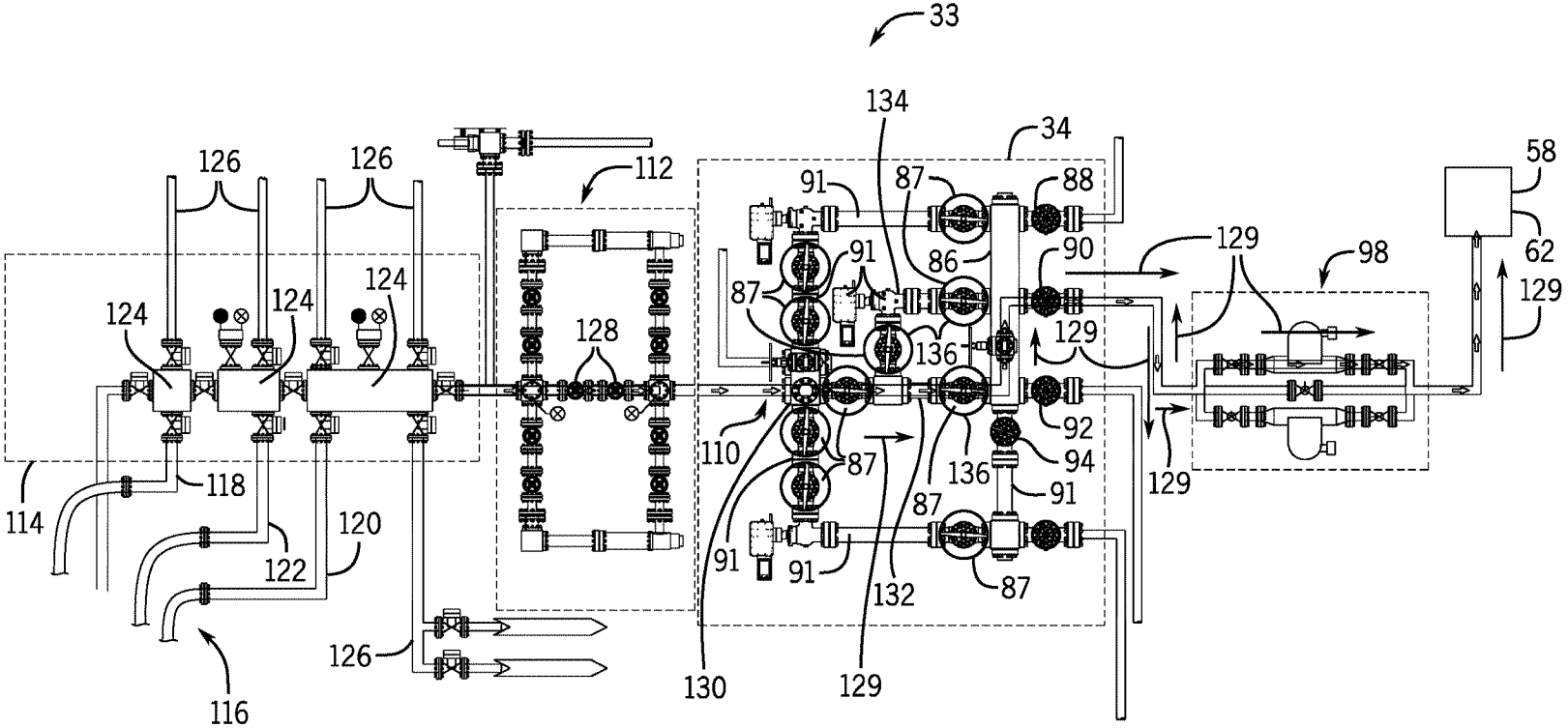
FIG. 4 is schematic of a second drilling fluid flow path through the enhanced manifold assembly that enables the mineral extraction system to perform a second drilling technique, in accordance with an aspect of the present disclosure.

FIG. 4 is a schematic of an embodiment of the manifold assembly 34 when the mineral extraction system 10 operates using the MPD technique. As shown in the illustrated embodiment of FIG. 4, the drilling fluid may be directed into the manifold assembly 34 via a second inlet 110 of the manifold assembly 34. In some embodiments, the second inlet 110 may be coupled to one or more upstream components that are configured to receive and/or process the drilling fluid exiting the wellbore 18. For example, the second inlet 110 may be fluidly coupled to a filter component 112 (e.g., a junk catcher) and/or a distribution manifold 114.

The distribution manifold 114 may receive the drilling fluid from the wellbore 18 via one or more inlet lines 116. In some embodiments, the distribution manifold 114 may receive drilling fluid from a bleed line 118, a primary flow line 120, and/or a secondary flow line 122. As used herein, the bleed line 118 may include a conduit that enables drilling fluid to flow from the wellbore 18 (e.g., in the riser 28) to the distribution manifold 114 when a pressure in the wellbore 18 exceeds a threshold (e.g., pressure relief in the wellbore 18 is desired). Additionally, the primary flow line 120 may include a conduit in which the drilling fluid typically flows from the wellbore 18 to the distribution manifold 114 (e.g., during MPD operation). The secondary flow line 122 may receive excess drilling fluid (e.g., a flow of drilling fluid above a threshold volumetric flow) that may not be directed to the distribution manifold 114 by the primary flow line 120. Utilizing each of the inlets 116 may enable more accurate control over pressure in the wellbore 18 by providing additional lines through which the drilling fluid may flow from the wellbore 18 to the rig 30.

The distribution manifold 114 may include one or more flow control devices 124 (e.g., valves and/or flow meters) that may control an amount of the drilling fluid that flows from the distribution manifold 114 to the filter component 112. The flow control devices 124 may also determine a flow path of the drilling fluid received by the distribution manifold 114. For example, in some cases, it may be desirable to direct the drilling fluid to bypass the filter component and/or the manifold assembly 34. Accordingly, the distribution manifold 114 may include one or more outlet lines 126 that may be configured to direct the drilling fluid away from the filter component 112 and/or the manifold assembly 34 and toward another component (e.g., the fluid container 50 and/or a waste system).

In some embodiments, the distribution manifold 114 may be configured to direct the drilling fluid (e.g., at a controlled flow rate) to the filter component 112 during MPD operations. The filter component 112 may include a junk catcher and/or another similar filter that collects undesired materials from the drilling fluid. For example, in some embodiments, the filter component 112 may remove large particles a formation (e.g., cuttings) collected by the drilling fluid when flowing through the wellbore 18. Additionally, the filter component 112 may remove and/or reduce a concentration of other undesired materials such as chemicals (e.g., injected into the wellbore 18 during the drilling process), hydrocarbons collected in the drilling fluid as it flows through the wellbore 18, and/or other foreign substances that may reduce an effectiveness of the drilling fluid.

As shown in the illustrated embodiment of FIG. 4, the filter component 112 may include one or more filters 128 that may remove the undesired materials from the drilling fluid. For example, the filters 128 may include mesh screens, perforated barriers, membranes, and/or any other suitable type of filter configured to catch the undesired materials and/or restrict a flow of the undesired materials in the drilling fluid from flowing toward the manifold assembly 34.

Drilling fluid may ultimately enter the manifold assembly 34 through the second inlet 110. A second drilling fluid flow path that may be utilized when operating using the MPD technique is represented by arrows 129. In some embodiments, the second inlet 110 may be fluidly coupled to a valve 130 (e.g., a ball valve, a choke valve, a gate valve, a needle valve, and/or a combination thereof), which may be configured to adjust a flow of the drilling fluid that flows through the manifold assembly 34 during MPD operations. The drilling fluid may ultimately flow through a conduit 132 of the manifold assembly 34 toward the second valve 90, which is included in the common manifold 86. Accordingly, the drilling fluid may be directed into the common manifold 86 when the mineral extraction system 10 operates using both the MPD and WCD techniques. Thus, the common manifold 86 includes each of the outlets of the manifold assembly 34 that directs the drilling fluid to downstream components regardless of which drilling technique is being employed. As discussed above, the second valve 90 may be fluidly coupled to the flow meter 98 (e.g., ultrasonic flow meters, fixed or variable orifices, venturies, rotameters, pitot tubes, thermal flow meters, coriolis flow meters, or other suitable flow meters), which may finely adjust a flow rate of the drilling fluid toward the mud gas separator 62 and/or the shaker 58.

As shown in the illustrated embodiment, the drilling fluid is directed from the valve 130 through the conduit 132 toward the second valve 90. However, in other embodiments, the drilling fluid may be directed through a secondary conduit 134 by opening and closing one or more valves 136 within the conduits 132 and 134. The secondary conduit 134 may be utilized when material builds up in the conduit 132, such that a flow of the drilling fluid through the conduit 132 is reduced. Accordingly, the drilling fluid may bypass the conduit 132 and still flow to the second valve 90 through the second conduit 134. When the drilling fluid flows through the second conduit 134, an operator may remove the material blocking the conduit 132 without shutting down operation of the mineral extraction system 10.

Figure 5:
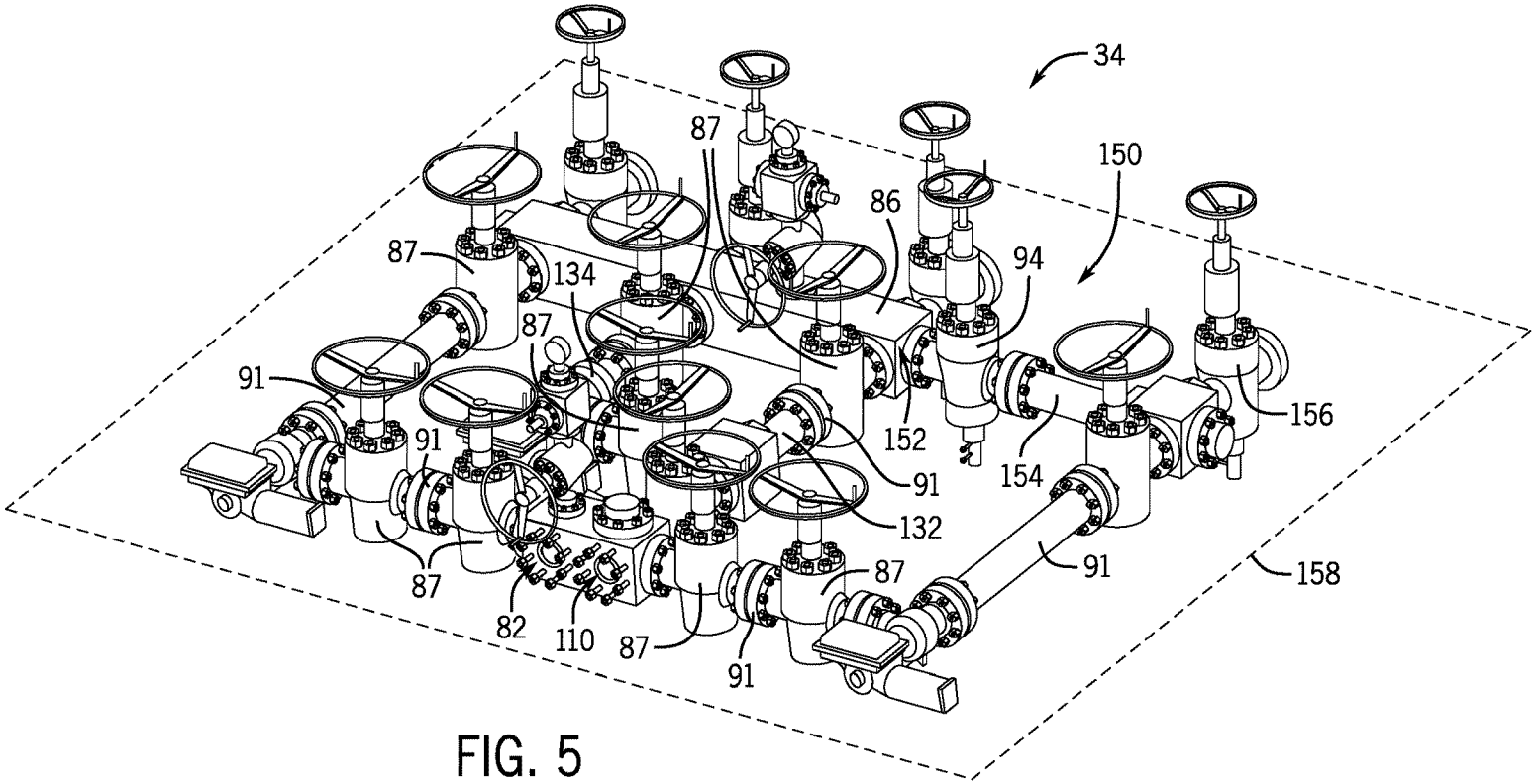
FIG. 5 is a perspective view of the enhanced manifold assembly in a first configuration, in accordance with an aspect of the present disclosure.

FIG. 5 is a perspective view of the manifold assembly 34 in a first configuration 150. As shown in the illustrated embodiment of FIG. 5, the fourth valve 94 is positioned on a first face 152 of the common manifold 86. Accordingly, a conduit 154 and a fifth valve 156 are disposed within a common plane 158 as the common manifold 86, the conduits 132 and 134, and/or the first and second inlets 82 and 110. However, as discussed above, it may be desirable to conserve space because of the limited space available on the rig 30 and/or a platform of the rig 30. Accordingly, the manifold assembly 34 may include a second configuration 170, as shown in FIG. 6.

Figure 6:
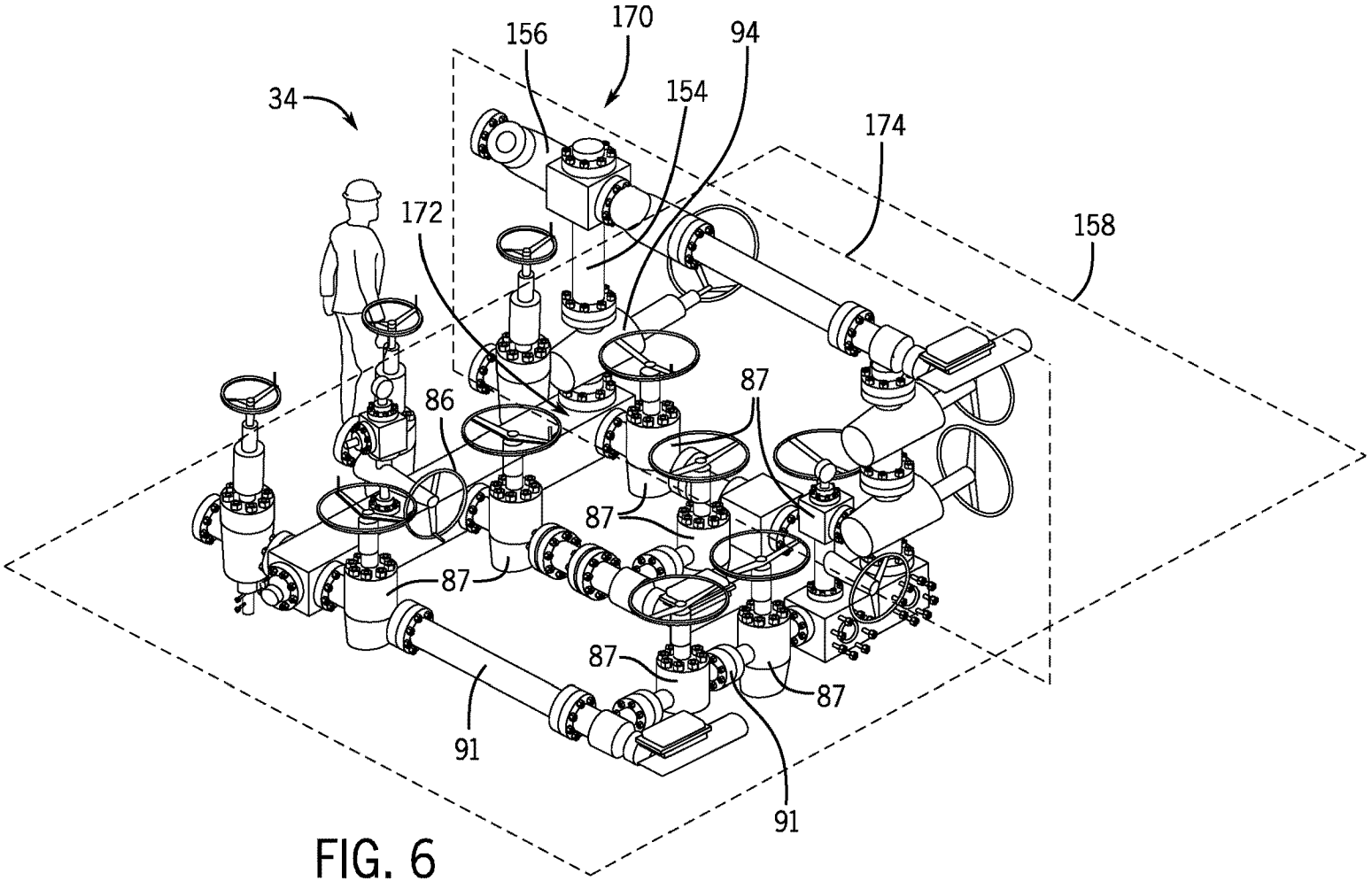
FIG. 6 is a perspective view of the enhanced manifold assembly in a second configuration, in accordance with an aspect of the present disclosure.

For example, FIG. 6 is a perspective view of the manifold assembly 34 in the second configuration 170, which may be configured to reduce a footprint of the manifold assembly 34. As shown in the illustrated embodiment of FIG. 6, the fourth valve 94 is positioned on a second face 172 of the common manifold 86, where the second face 172 (e.g., horizontal face or top face) is substantially perpendicular to the first face 152 (e.g., vertical face or side face). Accordingly, the conduit 154 may extend vertically from the plane 158 and the second face 172. Thus, the fifth valve 156 may be positioned above the common manifold 86 with respect to the plane 158. In other words, the fourth valve 94, the conduit 154, and/or the fifth valve 156 may be positioned within a second plane 174, where the second plane 174 is crosswise (e.g., substantially perpendicular) to the first plane 158. As such, the manifold assembly 34 having the second configuration 170 may be configured to fit within a smaller area than the manifold assembly 34 having the first configuration 150. It should be noted that both the first configuration 150 and the second configuration 170 of the manifold assembly 34 may be configured to direct the drilling fluid along both the first flow path 84 and the second flow path 129.

While the presently disclosed embodiments may be susceptible to various modifications and alternative forms, specific embodiments have been shown by way of example in the drawings and have been described in detail herein. However, it should be understood that the present disclosure is not intended to be limited to the particular forms disclosed. Rather, the present disclosure is to cover all modifications, equivalents, and alternatives falling within the spirit and scope of the present disclosure as defined by the following appended claims.

The invention claimed is:

1. A system, comprising:

a distribution manifold, wherein the distribution manifold couples directly to a bleed line;

a manifold assembly coupled to the distribution manifold, the manifold assembly comprising:

a first drilling fluid flow path configured to enable operation of a first drilling technique for a mineral extraction system, wherein the first drilling fluid flow path comprises a first inlet and a plurality of first outlets, and wherein the first inlet couples directly to a choke line of a wellbore and wherein the plurality of first outlets are fluidly coupled to a mud gas separator, a flare, a shaker or a combination thereof; and a second drilling fluid flow path configured to enable operation of a second drilling technique for the mineral extraction system, different from the first drilling technique, wherein the second drilling fluid flow path comprises a second inlet and a second outlet, wherein the first drilling fluid flow path and the second drilling fluid flow path are different from one another, and wherein the second inlet fluidly couples to the distribution manifold, and wherein the second outlet is fluidly coupled to a flow meter.

2. The system of claim 1, wherein the first drilling technique comprises well control drilling and the second drilling technique comprises managed pressure drilling.

3. The system of claim 1, wherein a first portion of the first drilling fluid flow path is disposed on a first plane and a second portion of the first drilling fluid flow path is disposed on a second plane, wherein the first plane and the second plane are crosswise to one another.

4. The system of claim 1, wherein the first inlet is fluidly coupled to a choke valve configured to reduce a pressure of drilling fluid flowing from the choke line into the first drilling fluid flow path.

5. The system of claim 1, wherein the second inlet is fluidly coupled to the distribution manifold, a filter, or a combination thereof.

6. The system of claim 5, wherein the distribution manifold is configured to adjust a flow rate of drilling fluid flowing into the filter.

7. The system of claim 6, wherein the filter comprises one or more mesh screens, membranes, or a combination thereof.

8. A system, comprising:

a manifold assembly, comprising:

a first drilling fluid flow path configured to enable operation of a well control drilling technique for a mineral extraction system, wherein the first drilling fluid flow path comprises a first inlet fluidly coupled to a choke line of a wellbore;

a second drilling fluid flow path configured to enable operation of a managed pressure drilling technique for the mineral extraction system, wherein the second drilling fluid flow path comprises a second inlet fluidly coupled to a distribution manifold, and wherein the first drilling fluid flow path and the second drilling fluid flow path are different from one another; and a manifold downstream from the first and second inlets, wherein the manifold comprises a first manifold outlet fluidly coupled to a mud gas separator, a second manifold outlet fluidly coupled to a flow meter, and a third manifold outlet fluidly coupled to a flare, and wherein the first manifold outlet, the second manifold outlet, and the third manifold outlet are downstream from the first inlet and the second inlet, and wherein the first drilling fluid flow path comprises the first manifold outlet and the third manifold outlet and the second drilling fluid flow path comprises the second manifold outlet.

9. The system of claim 8, wherein a first portion of the first drilling fluid flow path is disposed on a first plane and a second portion of the first drilling fluid flow path is disposed on a second plane, wherein the first plane and the second plane are crosswise to one another.

10. The system of claim 8, wherein the second inlet is fluidly coupled to a bleed line of the wellbore, a primary drilling fluid flow line, a secondary drilling fluid flow line, or a combination thereof via the distribution manifold.

11. The system of claim 10, wherein the second inlet is fluidly coupled to the distribution manifold, a filter, or a combination thereof.

12. A system, comprising:

a manifold assembly, comprising:

a first inlet;

a second inlet;

a manifold comprising a first outlet, a second outlet, a third outlet, and a fourth outlet;

a first drilling fluid flow path configured to enable operation of a well control drilling technique for a mineral extraction system, wherein the first drilling fluid flow path extends from the first inlet to the first outlet, the third outlet, and the fourth outlet of the manifold, wherein a first portion of the first drilling fluid flow path is disposed on a first plane and a second portion of the first drilling fluid flow path is disposed on a second plane, wherein the first plane and the second plane are crosswise to one another, and wherein the first outlet is fluidly coupled to a mud gas separator, the third outlet is fluidly coupled to a flare, and the fourth outlet is fluidly coupled to a shaker; and a second drilling fluid flow path configured to enable operation of a managed pressure drilling technique for the mineral extraction system, wherein the second drilling fluid flow path extends from the second inlet to the second outlet of the manifold, the second drilling fluid flow path comprising first and second secondary flow paths, and wherein the first drilling fluid flow path and the second drilling fluid flow path are different from one another, and wherein the second outlet is fluidly coupled to a flow meter;

a distribution manifold coupled to the manifold assembly; and a filter component coupled to the manifold assembly and the distribution manifold, wherein the filter component is upstream from the manifold assembly and downstream from the distribution manifold, wherein the first inlet is fluidly coupled to a choke line of a wellbore, and the second inlet is fluidly coupled to the distribution manifold and the filter component.

13. The system of claim 12, wherein the second inlet is fluidly coupled to a bleed line of the wellbore, a primary drilling fluid flow line, a secondary drilling fluid flow line, or a combination thereof via the distribution manifold and the filter component.

14. The system of claim 12, wherein the flow meter is downstream from the manifold.

* * * * *